United States Patent [19]

Uozumi

[11] Patent Number: 4,462,365

[45] Date of Patent: Jul. 31, 1984

[54] APPARATUS FOR SUPPLYING FUEL TO AN INTERNAL COMBUSTION ENGINE

[75] Inventor: Junzo Uozumi, Nagoya, Japan

[73] Assignee: Aisan Kogyo Kabushiki Kaisha, Obu, Japan

[21] Appl. No.: 505,936

[22] Filed: Jun. 20, 1983

[30] Foreign Application Priority Data

Oct. 21, 1982 [JP] Japan ..... 57-186259

[51] Int. Cl.[3] ..... F02B 33/00

[52] U.S. Cl. ..... 123/438; 123/445; 123/480; 123/446; 123/457

[58] Field of Search ..... 123/438, 445, 480, 446, 123/457, 495, 434, 505, 510, 511, 512

[56] References Cited

U.S. PATENT DOCUMENTS

| | | | |
|---|---|---|---|
| 4,294,212 | 10/1981 | Aoki | 123/438 |
| 4,311,126 | 1/1982 | Cowles | 123/438 |
| 4,344,398 | 8/1982 | Ikeura | 123/445 |
| 4,347,822 | 9/1982 | Casey | 123/445 |
| 4,378,000 | 3/1983 | Moriya et al. | 123/445 |

*Primary Examiner*—Raymond A. Nelli

*Attorney, Agent, or Firm*—Dennison, Meserole, Pollack & Scheiner

[57] ABSTRACT

Disclosed herein is an apparatus for supplying fuel to an internal combustion engine. The apparatus comprises an air regulator located at an air passage between a nozzle and an air pump for generating an air pressure $P_a$ and maintaining a pressure differential between pressure in an air intake passage and the air pressure $P_a$ at a predetermimed value corresponding to engine operations, a fuel regulator located at a fuel passage between the nozzle and a fuel pump for generating a fuel pressure $P_f$ and maintaining a pressure differential between pressure in the air intake passage and the fuel pressure $P_f$ at a predetermined value corresponding to engine operations, an air sensor for sensing the amount of suction air to the air intake passage and outputting a signal corresponding to the amount of suction air, a computer for receiving the signal from the air sensor and outputting a signal corresponding to a predetermined pressure differential between the air pressure $P_a$ and the fuel pressure $P_f$ in response to the signal from the air sensor and means located at at least one of the fuel passage and the air passage for receiving a signal from the computer and maintaining the pressure differential between the air pressure $P_a$ and the fuel pressure $P_f$ at a required value.

9 Claims, 6 Drawing Figures

APPARATUS FOR SUPPLYING FUEL TO AN INTERNAL COMBUSTION ENGINE

BACKGROUND OF THE INVENTION

This invention relates to an apparatus for supplying fuel to an internal combustion engine, and more particularly to an apparatus for supplying fuel to the engine, wherein pressurized fuel and pressurized air are mixed in a nozzle from which fuel and air mixture is injected to an air intake passage of the engine and at least one of the pressure of the pressurized air and the pressure of the pressurized fuel is controlled in response to change in the amount of suction air to preset the pressure differential between the air pressure and the fuel pressure to a required value and to achieve an optimal air-fuel ratio for engine operations.

As a conventional fuel supplying system in an internal combustion engine, for example, which is well-known in Japanese Patent Publication No. 47-4850, two opposed nozzles are arranged in an air intake cylinder, one of which is supplied with fuel having a constant pressure and the other is supplied with pressure-adjusted air, whereby the fuel and air are mixed in the air intake cylinder to control the fuel supply.

In this kind of fuel supplying system, fuel having a constant pressure is fed from a fuel pump to a fuel nozzle opening into the air intake cylinder and constant pressure of the air fed from an air pump is controlled by a valve mechanism operable responsive to engine speeds and suction vacuum or to throttle valve opening degree and suction vacuum and then the pressure-controlled air is fed to an air nozzle opening into the air intake cylinder. The fuel and air injected from the fuel and air nozzles, respectively, are mixed in the air intake cylinder and the fuel and air mixture is supplied to the engine. However, since this type of fuel supplying system mechanically controls the amount of fuel and air injected from both of the nozzles by using a valve mechanism such as a diaphragm in response to a plurality of signals corresponding to engine speeds, suction vacuum and so on, it cannot follow various operational conditions of the engine accurately and as a result, it cannot supply fuel and air mixture having a suitable air-fuel ratio responsive to the engine operations.

Moreover, the conventional fuel supplying system requires various control mechanisms in order to achieve a proper air-fuel ratio characteristic and is complicated in structure. Further, at such a low flow rate of the fuel and air mixture as under an engine idling condition, fuel is heated and a proper fuel and air mixture cannot be supplied to the engine, resulting in engine malfunction.

SUMMARY OF THE INVENTION

Accordingly, a primary object of the present invention is to provide an apparatus for supplying fuel to the engine which may supply fuel and air mixture having a suitable air-fuel ratio in response to engine operations and has a simple structure.

Another object of the present invention is to provide an apparatus for supplying fuel which may atomize fuel completely upon mixing of fuel and air and achieve uniform air-fuel ratio throughout the distribution of fuel and air mixture.

Further object of the present invention is to provide an apparatus for supplying fuel which may prevent fuel from being heated by the engine and operate the engine stably even at a low flow rate of fuel and air mixture such as under an engine idling condition.

According to the present invention, the apparatus for supplying fuel to an internal combustion engine includes a fuel pump, an air pump, an air intake passage, a nozzle mounted in the air intake passage and adapted to communicate with the fuel pump and the air pump, the nozzle having a discharge opening which opens into the air intake passage, an air restriction and a fuel restriction which lead to the discharge opening, an air valve mounted in the air intake passage and a throttle valve provided downstream of the air valve, wherein fuel and air passing through the fuel restriction and the air restriction are mixed in the nozzle and are injected from the discharge opening to the air intake passage. The invention is characterized in that the apparatus comprises an air regulator located at an air passage between the nozzle and the air pump for generating an air pressure $P_a$ and maintaining a pressure differential between pressure in the air intake passage and the air pressure $P_a$ at a predetermined value corresponding to engine operations, a fuel regulator located at a fuel passage between the nozzle and the fuel pump for generating a fuel pressure $P_f$ and maintaining a pressure differential between pressure in the air intake passage and the fuel pressure $P_f$ at a predetermined value corresponding to engine operations, an air sensor for sensing the amount of suction air to the air intake passage and outputting a signal corresponding to the amount of suction air, a computer for receiving the signal from the air sensor and outputting a signal corresponding to a predetermined pressure differential between the air pressure $P_a$ and the fuel pressure $P_f$ in response to the signal from the air sensor and means located at at least one of the fuel passage and the air passage for receiving a signal from the computer and maintaining the pressure differential between the air pressure $P_a$ and the fuel pressure $P_f$ at a required value.

Other features and advantages of the invention will be apparent from the following description taken in connection with the accompanying drawings.

DETAILED DESCRIPTION OF THE PREFERRED EMBODIMENTS

Figure 1:
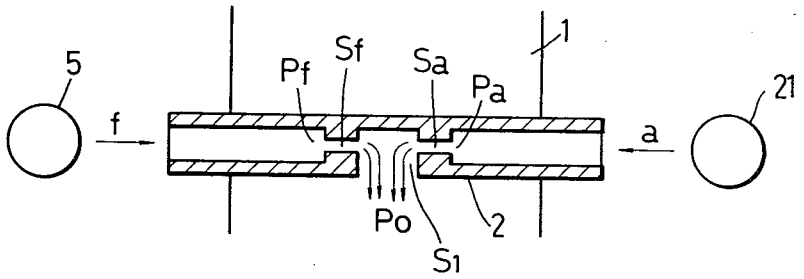
FIG. 1 shows the principle of the operation of the invention.
Figure 2:
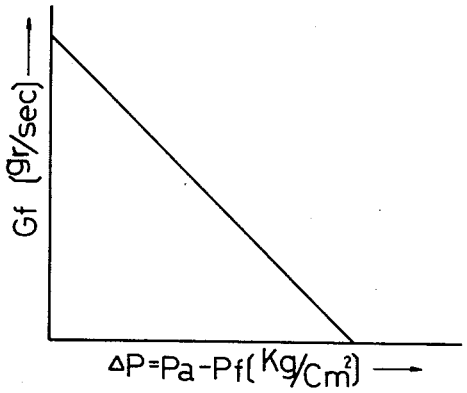
FIG. 2 shows a relation between the amount of fuel flow and the pressure differential between the air pressure and the fuel pressure in FIG. 1.
Figure 3:
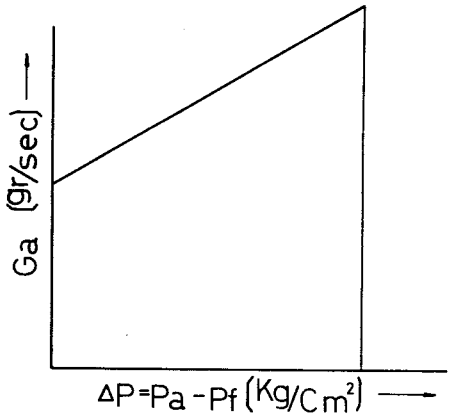
FIG. 3 shows a relation between the amount of air flow and the pressure differential between the air pressure and the fuel pressure in FIG. 1.

Referring now to FIGS. 1 to 3 which show the principle of this invention, reference numerals 1 and 2 designate an air intake cylinder in which fuel and air are mixed and a nozzle for mixing fuel flow and air flow in the air intake cylinder 1, respectively. Reference numerals 5 and 21 designate a fuel pump and an air pump, respectively. Symbols f, a, $S_f$, $S_a$ and $S_1$ represent fuel, air, fuel restriction, air restriction and discharge port from which fuel and air are discharged, respectively. If pressure in the air intake cylinder 1, pressure of fuel fed from the fuel pump 5 at the directly fore portion of the fuel restriction $S_f$ and pressure of air fed from the air pump 21 at the directly fore portion of the air restriction $S_a$ are represented by $P_0$, $P_f$ and $P_a$, respectively, the amount of fuel and air discharged from the discharge port $S_1$ is dependent upon the pressure differential between the air pressure $P_a$ and the fuel pressure $P_f$.

In other words, when the air pressure $P_a$ is increased to the values greater than a predetermined value, the fuel supplied through the fuel restriction $S_f$ is stopped by the air flow supplied through the air restriction $S_a$. However, as the air pressure $P_a$ is decreased from the predetermined value, the amount of fuel to be supplied is increased. Accordingly, the amount of fuel flow $G_f$ discharged through the discharge port $S_1$ is substantially linearly changed relative to the pressure differential $\Delta P = P_a - P_f$ as shown in FIG. 2 and becomes maximum in case of $P_a = P_f$. On the other hand, the amount of air flow $G_a$ discharged through the discharge port $S_1$ is linearly changed as shown in FIG. 3.

As will be appreciated from FIGS. 2 and 3, in order to obtain an optimal air-fuel ratio of fuel and air mixture in various engine operations, it is necessary to control the amount of air flow $G_a$ and the amount of fuel flow $G_f$ according to the pressure differential $\Delta P = P_a - P_f$.

According to this invention, the amount of fuel flow $G_f$ is controlled by a fuel regulator in response to engine operations according to a predetermined pressure differential ($P_f - P_0$) between the fuel pressure $P_f$ and the air pressure $P_0$ in the air intake cylinder 1 at a certain engine operation, and the amount of air flow $G_a$ is controlled by an air regulator in response to the amount of air sucked into the air intake cylinder 1 in various engine operations according to a predetermined pressure differential ($P_a - P_f$) to maintain an air-fuel ratio of fuel and air mixture including air to be sucked into the air intake cylinder 1 at an optimal value.

Figure 4:
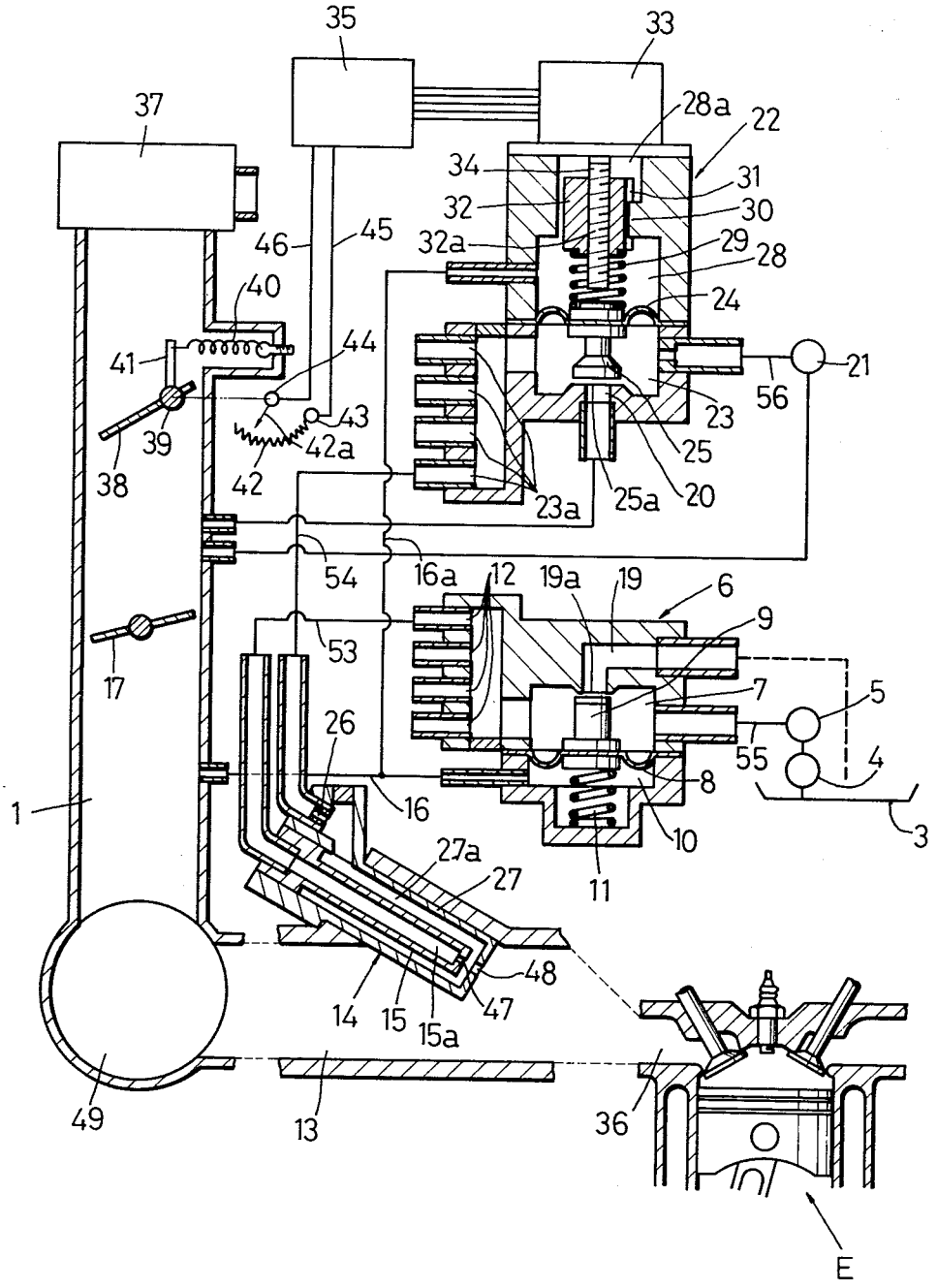
FIG. 4 is a vertical cross-sectional view of the apparatus of the first embodiment.

Referring next to FIG. 4 which shows a first embodiment, in which identical reference numbers as in FIG. 1 designate identical parts, reference numerals 3, 4 and 5 designate a fuel tank, a fuel filter and a fuel pump, respectively. Reference numeral 6 designates a fuel regulator composed of a fuel chamber 7 and a vacuum chamber 10 which are separated by a diaphragm 8. The vacuum chamber 10 is communicated through a vacuum passage 16 with the air intake cylinder 1 and a compression spring 11 is accommodated in the vacuum chamber 10. The fuel chamber 7 is communicated through a fuel passage 55 with the fuel pump 5, the fuel filter 4 and the fuel tank 3. The diaphragm 8 is provided with a valve 9 projecting into the fuel chamber 7. The fuel regulator 6 is formed with a fuel return passage 19 therein communicating with the fuel chamber 7 and with the fuel tank 3. The valve 9 serves to close and open a return port **19*a* of the return passage 19 opening into the fuel chamber 7. The fuel regulator 6 also includes a plurality of fuel outlet ports 12 (four outlet ports are shown in this embodiment, the number of which corresponds to the number of engine cylinder.) communicating with the fuel chamber 7**.

Reference numeral 22 designates an air regulator having an air chamber 23 and a vacuum chamber 28 which are separated by a diaphragm 24. The air chamber 23 is communicated through an air passage 56 with an air pump 21 which leads to the air intake cylinder 1 between an air valve 38 and a throttle valve 17. The diaphragm 24 is provided with a valve 25 projecting into the air chamber 23. The air regulator 22 is formed with an air return passage 20 therein communicating with the air chamber 23 and with the air intake cylinder 1 between the air valve 38 and the throttle valve 17. The valve 25 serves to close and open a release port **25*a* of the return passage 20 opening into the air chamber 23. The air regulator 22 includes an air outlet ports 23*a*, the number of which is identical with that of the fuel outlet port 12 of the fuel regulator 6, communicating with the air chamber 23. A retainer chamber 28*a* having a smaller diameter than that of the vacuum chamber 28 is defined on the upper side of the vacuum chamber 28, and a retainer 32 is slidably inserted in the retainer chamber 28*a*. The retainer 32 is formed with an axially extending guide channel 31 on the outer circumference thereof and a guide member 30 is projected from the inside surface of the retainer chamber 28 so as to engage with the guide channel 31. A compression spring 29 is accommodated in the vacuum chamber 28 and is compressed between the retainer 32 and the diaphragm 24. The vacuum chamber 28 is communicated through the vacuum passages 16*a* and 16 with the air intake cylinder 1 downstream of the throttle valve 17**.

An electric actuator 33 having a screw rod 34 is attached on the upper end of the air regulator 22 and the screw rod 34 is screwed into a threaded hole **32*a* opened through the retainer 32**.

An air valve 38 is fixed to an eccentric shaft 39 rotatably supported by the air intake cylinder 1. A lever 41 is fixed at its one end to the eccentric shaft 39 and is connected at its another end to a coil spring 40 one end of which is fixed to the air intake cylinder 1. Rotation of the eccentric shaft 39 is transmitted through a linkage mechanism (not shown) to a rotary slide member **42*a* of a variable resistor 42. Reference numerals 43 and 44 designate terminals of the variable resistor 42 and the rotary slide member 42*a*, respectively, which are connected through wirings 45 and 46 to a computer 35**.

The computer 35 is connected to an electric actuator 33 and when the computer 35 receives an output signal of the variable resistor 42 which signal is in proportion to the amount of suction air passing through the air valve 38, it outputs to the electric actuator 33 a signal corresponding to the pressure differential $\Delta P$ between the air pressure $P_a$ in the air chamber 23 of the air regulator 22 and the fuel pressure $P_f$ in the fuel chamber 7 of the fuel regulator 6. The pressure differential $\Delta P$ is predetermined relative to the amount of the output signal of the variable resistor 42. The electric actuator 33 serves to rotate the screw rod 34 by the amount of the signal corresponding to the pressure differential $\Delta P$ to move the retainer 32 upwardly or downwardly. In association with this movement, the biasing force of the compression spring 29 is varied and the valve 25 is moved upwardly or downwardly through the diaphragm 24, thereby increasing or decreasing the amount of air released from the release port **25*a* through the return passage 20 to the air intake cylinder 1 between the air valve 38 and the throttle valve 17**.

The air intake cylinder 1 is communicated through an air intake manifold 49 with each air intake pipe 13 of an engine E. Reference numeral 36 designates an inlet port of the engine E. The air intake pipe 13 is provided with an injector 14. The injector 14 is composed of a fuel nozzle 15 and an air nozzle 27 surrounding the fuel nozzle 15. The fuel nozzle 15 is formed with a fuel nozzle chamber **15*a* therein and a fuel restriction 47 at the front end thereof. The air nozzle 27 is formed with an air nozzle chamber 27a defined by an annular space between the fuel nozzle 15 and the air nozzle 27, an air restriction 26 at the rear end thereof and a discharge opening 48 at the front end thereof which opening is opposed to the fuel restriction 47 and is opened into the air intake pipe 13**.

The rear end of the fuel nozzle 15 is communicated through a fuel passage 53 with the outlet port 12 of the fuel regulator 6 and the rear end of the air nozzle 27 is communicated through the air restriction 26 and the air passage 54 with the outlet port 23a of the air regulator 22. The fuel passage 53 and the air passage 54 are arranged adjacent to each other so as for the air flowing in the air passage 54 to prevent the fuel flowing in the fuel passage 53 from being heated by the engine. Reference numerals 17 and 37 designate a throttle valve and an air cleaner provided on the air intake cylinder 1.

With this arrangement, the air valve 38 is rotated with the eccentric shaft 39 in response to the amount of suction air to the engine E, being well-balanced with the coil spring 40. The rotary slide member 42a is rotated in association with the rotation of the air valve 38 to vary the resistance of the variable resistor 42 and to output the amount of the variation of the resistance into the computer 35 as an electric signal. The amount of suction air passing through the air intake passage 1 is metered by an air flow sensor, wherein the rate of suction air flow is directly metered by an appropriate flow metering system such as a hot-wire type flow metering system, a discharge type flow metering system or a Kármán vortex type flow metering system and the amount of suction air is introduced by the metered value, or an another method wherein the amount of suction air is metered basically on an engine parameter such as an engine speed or an intake manifold vacuum. Any suitable method for metering the amount of suction air to the engine may be applicable. The computer 35 outputs to the electric actuator 33 the signal corresponding to the pressure differential $\Delta P$ between the air pressure $P_a$ of the air regulator 22 and the fuel pressure $P_f$ of the fuel regulator 6 in response to the signal from the air flow sensor. The electric actuator 33 rotates the screw rod 34 by the amount corresponding to the signal inputted to the electric actuator 33. As a result, the retainer 32 which rotation is restricted by the engagement of the guide member 30 and the guide channel 31 moves upwardly or downwardly and the biasing force of the compression spring 29 against the diaphragm 24 is varied. Pressurized air from the air pump 21 upwardly urges the diaphragm 24 from the air chamber 23 side. The sum of the suction air vacuum $P_0$ acting to the vacuum chamber 28 and the biasing force of the compression spring 29 is balanced with the air pressure $P_a$ in the air chamber 23 to open or close the valve 25 and release the excess air in the air chamber through the release port 25a to the air intake cylinder 1 between the air valve 38 and the throttle valve 17. In this way, the air pressure $P_a$ in the air chamber 23 becomes equal to $P_0+k_1$, wherein $k_1$ is the biasing force of the compression spring 29.

On the other hand, the pressurized fuel from the fuel pump 5 downwardly urges the diaphragm 8 from the fuel chamber 7 side. The sum of the suction air vacuum $P_0$ in the vacuum chamber 10 and the biasing force of the compression spring 11 is balanced with the fuel pressure $P_f$ in the fuel chamber 7 to open or close the valve 9 and return the excess fuel through the return passage 19 to the fuel tank 3. In this way, the fuel pressure $P_f$ in the fuel chamber 7 becomes equal to $P_0+k_2$, wherein $k_2$ is the biasing force of the compression spring 11. Accordingly, $(P_a-P_f)$ is equal to $(k_1-k_2)=\Delta P$ which is predetermined by the computer 35 with respect to the amount of suction air to the air intake cylinder 1 as is afore-mentioned.

As a result, the fuel of the fuel pressure $P_f$ in the fuel chamber 7 is fed through the fuel passage 53 to the fuel nozzle chamber 15a of the injector 14 and is in turn discharged from the fuel restriction 47. On the other hand, the air of the air pressure $P_a$ in the air chamber 23 is fed through the air passage 54 to the air restriction 26 and is discharged into the air nozzle chamber 27a. During flow of the air in the air passage 54, the fuel flowing in the fuel passage 53 is prevented to be heated by the engine. The fuel and the air are mixed in the air nozzle chamber 27a and are injected through the discharge opening 48 to the air intake pipe 13.

In such an engine operation as with a small amount of suction air, for example, the displacement of rotation of the air valve 38 is small and the variable resistor 42 outputs a small resistance to the computer 35. As a result, the computer 35 outputs a signal corresponding to a large pressure differential $\Delta P$ to the electrical actuator 33 and thereby the electrical actuator 33 rotates the screw rod 32a in such a direction as to increase the biasing force of the compression spring 29 of the air regulator 22 and to lower the retainer 32. Accordingly, the valve 25 is closed and therefore the air pressure $P_a$ in the air chamber 23 is increased. Fuel supply is hindered because of the large air pressure $P_a$ and a small amount of fuel is supplied from the fuel pump 5 to the fuel chamber 7 as is appreciated from FIG. 2. The air of such a large air pressure $P_a$ is mixed in the air nozzle chamber 27a with the fuel of the fuel pressure $P_f$ in the fuel chamber 7 which pressure is controlled correspondingly to the afore-mentioned engine operation. Because the amount of the air discharged from the discharge opening 48 into the air intake pipe 13 is equal to the difference between the amount of the air fed to the air regulator 22 from the air pump 21 and the amount of the air released from the air regulator 22 through the return passage 20 to the air intake cylinder 1, the air-fuel ratio, that is, the ratio of the amount of air flowing in the air intake pipe 13 to the amount of fuel injected from the discharge opening 48 becomes optimal in this engine operation.

Figure 5:
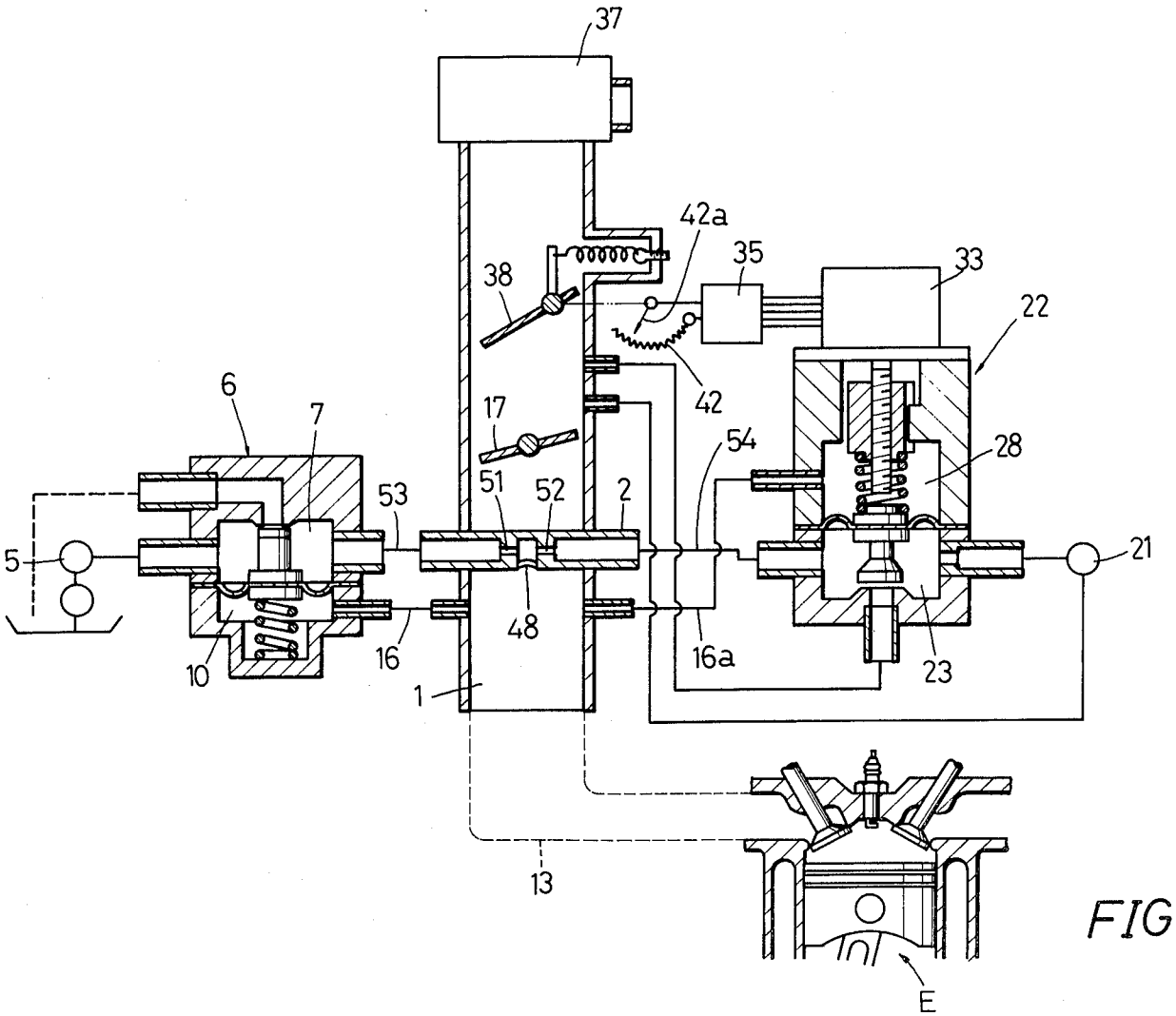
FIG. 5 is a vertical cross-sectional view of the apparatus of the second embodiment.

Referring next to FIG. 5 which shows a second embodiment, in which identical reference numbers as in FIG. 4 designate identical parts and the explanation thereof will be omitted, a nozzle 2 is provided on the air intake cylinder 1 at the downstream portion of the throttle valve 17 in place of the injector 14 in the first embodiment. The nozzle 2 is formed with a fuel restriction 51 and an air restriction 52 which are arranged in opposed relation with each other and also formed with a discharge opening 48 opening downstream of the air intake cylinder 1 between both the restrictions 51 and 52. The operation of the second embodiment is identical with that of the first embodiment.

Figure 6:
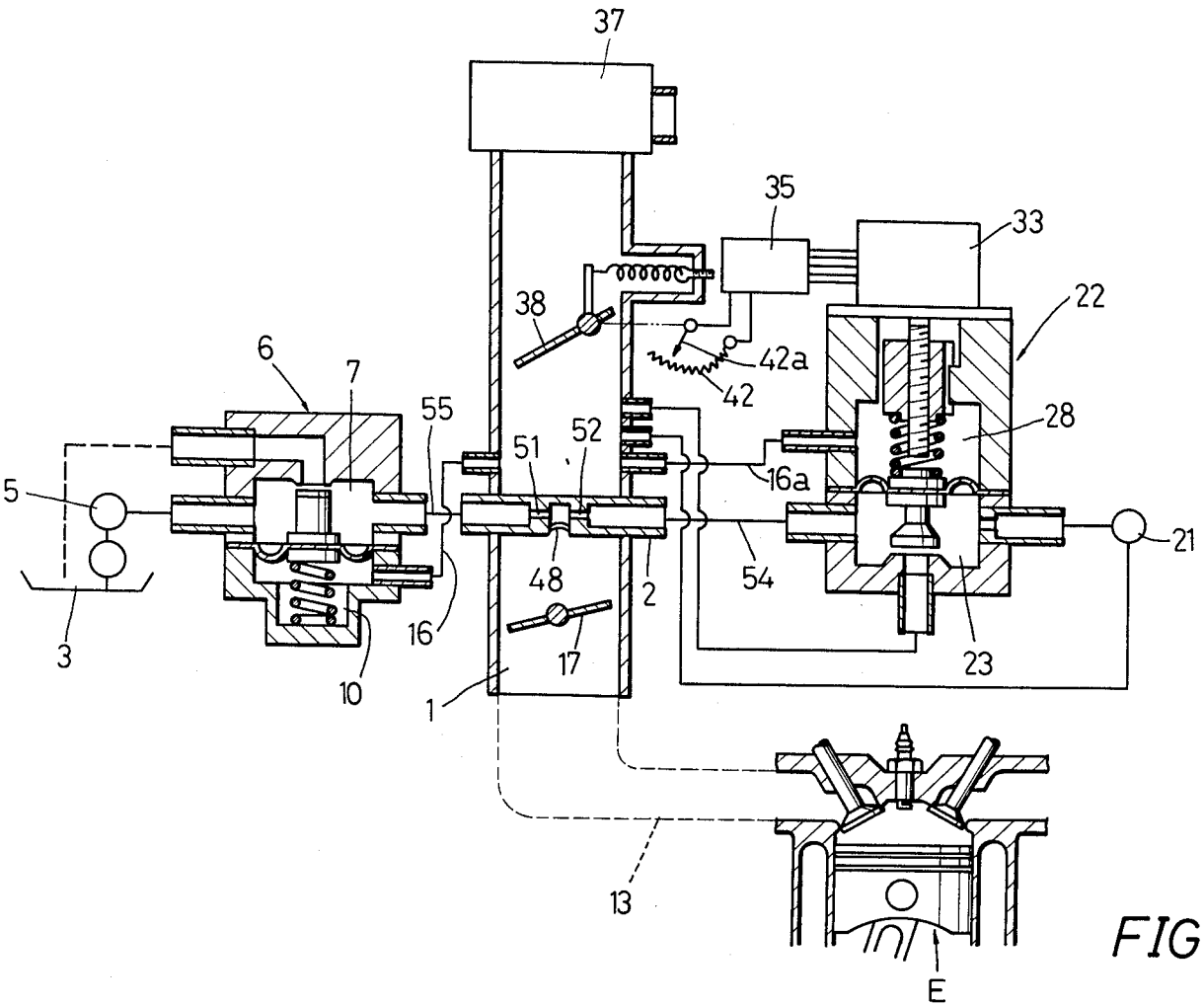
FIG. 6 is a vertical cross-sectional view of the apparatus of the third embodiment.

Referring next to FIG. 6 which shows a third embodiment, in which identical reference numbers as in FIG. 4 designate identical parts and the explanation thereof will be omitted, a nozzle 2 is provided on the air intake cylinder 1 between the throttle valve 17 and the air valve 38. The vacuum chamber 10 of the fuel regulator 6 and the vacuum chamber 28 of the air regulator 22 are communicated with the air intake cylinder 1 between the throttle valve 17 and the air valve 38. The operation of the third embodiment is identical with that of the first embodiment.

In the previous embodiments, a preset value of air pressure $P_a$ in the air chamber 23 of the air regulator 22 is changed by the electric actuator 33. In a modified manner, a preset value of fuel pressure $P_f$ in the fuel chamber 7 of the fuel regulator 6 may be changed by the electric actuator 33, or both of the preset values of air pressure $P_a$ and fuel pressure $P_f$ may be changed. In any case, the pressure differential $\Delta P$ between the air pressure $P_a$ and the fuel pressure $P_f$ ought to be set to a predetermined value relative to the amount of suction air to the air intake cylinder 1. In another way, an opening area of either or both of the fuel restriction 51 and the air restriction 52 as shown in FIG. 6, for example, may be changed so as to vary the amount of fuel flow $G_f$ and the amount of air flow $G_a$ as shown in FIGS. 2 and 3.

The electric actuator of the previous embodiments includes a stepping motor. However, in a modified embodiment, it may include an electromagnetic valve in place of a stepping motor.

While the invention has been shown and described in its preferred embodiments, it will be clear to those skilled in the arts to which it pertains that many changes and modifications may be made thereto without departing from the scope of the invention.

What is claimed is:

1. An apparatus for supplying fuel to an internal combustion engine including a fuel pump, an air pump, an air intake passage, a nozzle mounted in said air intake passage and adapted to communicate with said fuel pump and said air pump, said nozzle having a discharge opening which opens into said air intake passage, an air restriction and a fuel restriction which lead to said discharge opening, an air valve mounted in said air intake passage and a throttle valve provided downstream of said air valve, wherein fuel and air passing through said fuel restriction and said air restriction are mixed in said nozzle and are injected from said discharge opening to said air intake passage, said apparatus comprising:

an air regulator located at an air passage between said nozzle and said air pump for generating an air pressure $P_a$ and maintaining a pressure differential between pressure in said air intake passage and said air pressure $P_a$ at a predetermined value corresponding to engine operations;

a fuel regulator located at a fuel passage between said nozzle and said fuel pump for generating a fuel pressure $P_f$ and maintaining a pressure differential between pressure in said air intake passage and said fuel pressure $P_f$ at a predetermined value corresponding to engine operations;

an air sensor for sensing the amount of suction air into said air intake passage and outputting a signal corresponding to said amount of suction air;

a computer for receiving said signal from said air sensor and outputting a signal corresponding to a predetermined pressure differential between said air pressure $P_a$ and said fuel pressure $P_f$, said pressure differential corresponding to said signal from said air sensor; and means located at at least one of said fuel passage and said air passage for receiving a signal from said computer and maintaining said pressure differential between said air pressure $P_a$ and said fuel pressure $P_f$ at a required value.

2. The apparatus as defined in claim 1, wherein said fuel regulator includes a fuel chamber leading to said fuel pump, having a return port and holding a fuel pressure $P_f$, a first vacuum chamber leading to said air intake passage and a first diaphragm separating said fuel chamber from said first vacuum chamber.

3. The apparatus as defined in claim 1, wherein said air regulator includes an air chamber leading through said air pump to said air intake passage between said air valve and said throttle valve, leading through a release port to said air intake passage between said air valve and said throttle valve and holding an air pressure $P_a$, a second vacuum chamber leading to said air intake passage and a second diaphragm separating said air chamber from said second vacuum chamber.

4. The apparatus as defined in claim 1, wherein said means for maintaining said pressure differential between said air pressure $P_a$ and said fuel pressure $P_f$ at a required value is an electric actuator mounted on said air regulator, said electric actuator including a screw rod adapted to rotate responsive to said signal from said computer, a retainer adapted to move in said second vacuum chamber of said air regulator by the rotation of said screw rod and a compression spring disposed between said retainer and said second diaphragm of said air regulator.

5. The apparatus as defined in claim 1, wherein said nozzle is an injector located at an air intake pipe of the engine, said injector comprising a cylindrical fuel nozzle having said fuel restriction at its front end and a cylindrical air nozzle having said air restriction at its rear end and said discharge opening at its front end opposite to said fuel restriction of said fuel nozzle and surrounding said fuel nozzle.

6. The apparatus as defined in claim 5, wherein said fuel passage and said air passage are arranged partially adjacent to each other.

7. The apparatus as defined in claim 1, wherein said air restriction and said fuel restriction of said nozzle are oppositely arranged at a distance, and said discharge opening is provided between said air restriction and said fuel restriction.

8. The apparatus as defined in claim 7, wherein said nozzle is located directly downstream of said throttle valve.

9. The apparatus as defined in claim 7, wherein said nozzle is located between said air valve and said throttle valve.

* * * * *